United States Patent [19]

Gross

[11] Patent Number: 4,875,680

[45] Date of Patent: Oct. 24, 1989

[54] MINIATURE GOLF GAME APPARATUS

[76] Inventor: Douglas P. Gross, Rte. 1, Box 567, Cross Plains, Tenn. 37049

[21] Appl. No.: 232,161

[22] Filed: Aug. 15, 1988

[51] Int. Cl.[4] ..... A63F 7/06

[52] U.S. Cl. ..... 273/87 B; 273/87 C; 273/12; 273/176 FB

[58] Field of Search ..... 273/87 R, 87 B, 87 C, 273/87 D, 123 R, 127 R, 127 B, 176 R–176 F, 35, 8, 9, 2, 3 R, 3 A, 14, 12, 178 B, 113, 115, 116, 117, 85 R

[56] References Cited

U.S. PATENT DOCUMENTS

| | | | |
|---|---|---|---|
| 1,259,694 | 3/1918 | Weslow | 273/87 B |
| 1,813,116 | 7/1931 | Clausen | 273/176 E |
| 3,138,387 | 6/1964 | Michel et al. | 273/87 C |
| 4,063,728 | 12/1977 | Zemanek | 273/14 |

FOREIGN PATENT DOCUMENTS

| | | | |
|---|---|---|---|
| 387740 | 2/1933 | United Kingdom | 273/87 |

*Primary Examiner*—Edward M. Coven
*Assistant Examiner*—Sebastiano Passaniti
*Attorney, Agent, or Firm*—Harrington A. Lackey

[57] ABSTRACT

A miniature golf game apparatus adapted to be used with a movable playing piece, such as a golf ball, and a stick member for propelling the playing piece, such as a golf stick or putter, including a mat having a playing surface upon which a plurality of separately directed golf course routes are displayed and a plurality of elongated bumper rails adapted to be assembled in a spaced end-to-end relationship around the mat to form side and corner pocket spaces between the bumper rails. Eack pocket space is enclosed by an outboard pocket or net member detachably secured to the opposite adjacent end portions of the bumper rails. Preferably, the pocket spaces and pocket members are of the same number and spacing as the pockets in a conventional pool table so that the mat, also of substantially the same size as the playing surface of the pool table, may be mounted by itself upon the pool table or assembled with the bumper rails and pockt members upon a floor or ground supporting surface, so that the miniature golf game may be played upon a pool table, or upon a ground or floor supporting surface, or upon any other playing surface or playing table.

4 Claims, 2 Drawing Sheets

MINIATURE GOLF GAME APPARATUS

BACKGROUND OF THE INVENTION

This invention relates to a miniature golf apparatus, and more particularly to a versatile golf game apparatus capable of being played on various support surfaces.

Miniature golf courses of various sizes, types and designs for outdoor play, are well known in the art, but are basically of a permanent construction requiring substantial capitalization for construction and little, if no, adaptability for changing designs.

Pool tables of various sizes are also well known in the art.

Table top games simulating miniature golf adapted to be played with pool or billiard cues and billiard balls or disks are illustrated in the following U.S. Pat. Nos.:

| | | |
|---|---|---|
| 709,007 | Gibb | Sep. 16, 1902 |
| 1,566,057 | Wilkinson | Dec. 15, 1925 |
| 1,813,116 | Clausen | Jul. 7, 1931 |

The Clausen patent discloses a sheet or playing surface upon which is painted or formed various golf course routes and hazards and which is adapted to be placed upon an existing pool table in which the six corner pockets are utilized as golf holes.

British Pat. No. 387,740, dated Feb. 16, 1933, discloses a simulated miniature golf game incorporating a board at floor level encompassed by rails and displaying various simulated golf course routes, for playing with a conventional golf club and golf ball. The surrounding rails or walls are adapted to deflect the golf ball to rebound and move in routes similar to those experienced on a pool table.

However, none of the above patents disclose a miniature golf game apparatus including not only a flexible mat upon which is displayed a playing surface, preferably in the rectangular shape of a pool table for mounting thereon, but also a plurality of independent, discrete, bumper rails and detachably mountable pocket members for assembly with the mat to define a miniature golf playing surface at floor or ground level.

SUMMARY OF THE INVENTION

It is therefore an object of this invention to provide a miniature golf game apparatus which is versatile enough to be played upon a billiard table with a cue stick and billiard ball, or upon the ground or floor surface with a golf stick and a golf ball.

Another object of this invention is to provide a miniature golf game apparatus having a flexible mat upon which is formed a playing surface, which may easily be laid flat in an operative playing position or may be rolled up into a compact inoperative position, and a plurality of discrete bumper rails and detachable pocket members which may be assembled with the mat to define a miniature golf course at ground or floor level, and just as easily disassembled for storage or transportation in a minimum of space.

Another object of this invention is to provide a miniature golf game apparatus incorporating a flexible playing mat having a playing surface defining golf course routes, a plurality of discrete bumper rails and a plurality of connecting pocket or net members. The playing mat may be laid flat on a billiard table so that the routes terminate at the existing pockets on the billiard table for playing the miniature golf game on the billiard table with conventional cue sticks and cue balls or playing discs. The playing mat may also be placed at floor or ground level and surrounded by the assembled bumper rails and detachable pocket or net members for playing the game at floor or ground level with a conventional golf putter and golf ball or playing disc or playing piece. The connecting pocket or net members correspond in location and numbers to the pockets on a billiard table.

DESCRIPTION OF THE PREFERRED EMBODIMENTS

Figures 1, 2, 3:
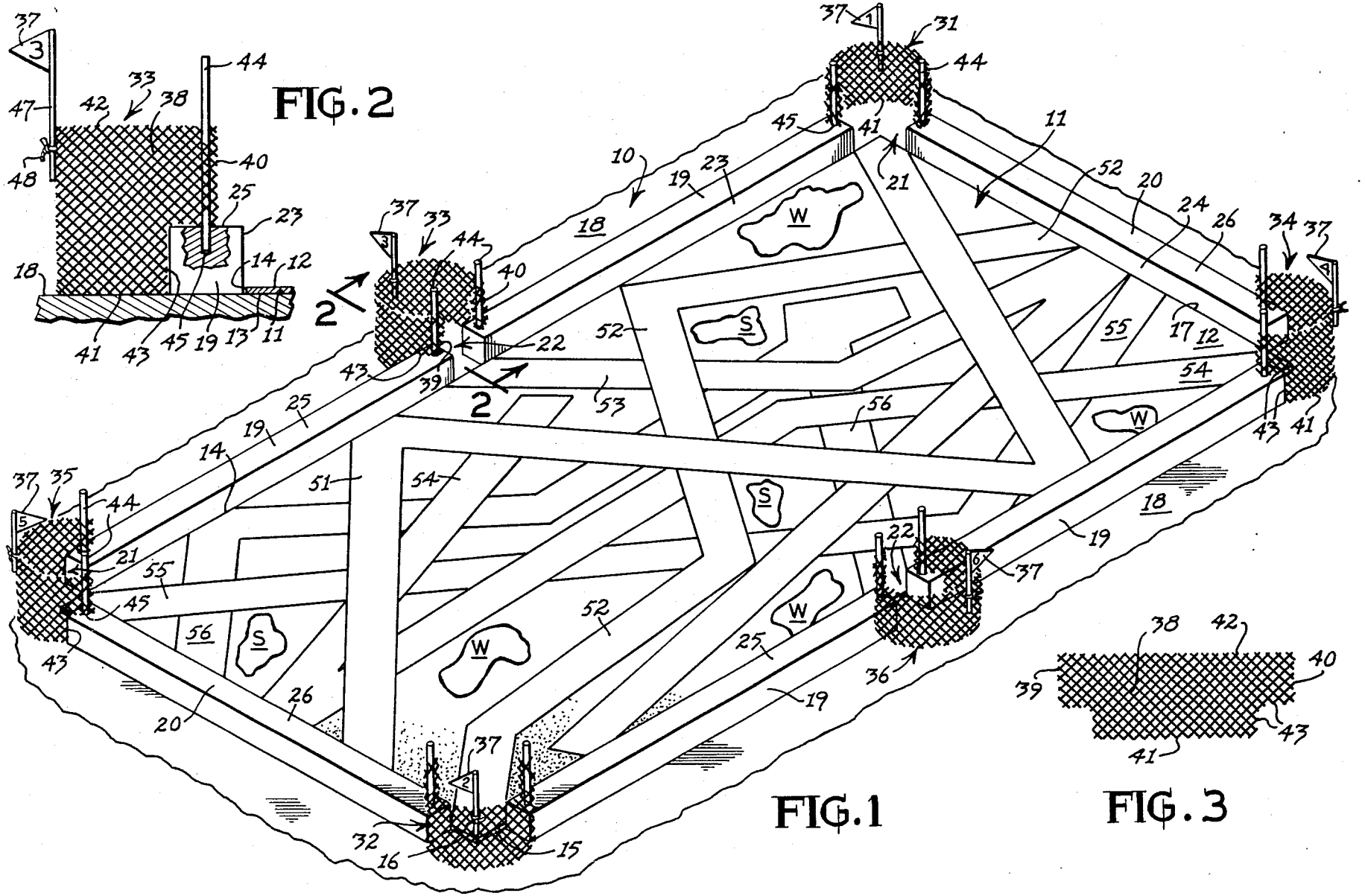
FIG. 1 is a top plan perspective view of the miniature golf game apparatus made in accordance with this invention and assembled in operative position upon a floor supporting surface, shown fragmentarily.
FIG. 2 is an enlarged fragmentary section taken along the line 2—2 of FIG. 1.
FIG. 3 is a reduced plan view of one of the pocket members in an extended position and before assembly.

Referring now to the drawings in more detail, the miniature golf game apparatus 10 made in accordance with this invention includes an elongated, preferably rectangular, flexible mat 11, having a top or face playing surface 12, a back surface 13, elongated side edges 14 and 15 and elongated end edges 15 and 16.

The mat 11 is made of a flexible material which will permit it to be coiled or rolled, preferably about its transverse axis, although it could be coiled about either transverse or longitudinal axes, so that the coiled mat 11 will occupy a minimum of space for storage or transportation. The mat 11 is also adapted to be uncoiled until it assumes its flat operative position disclosed in FIGS. 1 and 4.

In a preferred form of the invention, the mat 11 is adapted to be mounted upon a ground or floor supporting surface 18, so that the back surface 13 engages the floor surface 18, and preferably has a high coefficient of friction to prevent lateral or longitudinal displacement of the mat 11 when it is resting flat upon the support surface 18 and during play. The floor surface 18 may be the floor of a recreational room, or gymnasium, or an outdoor substantially level surface, such as a porch, a sun deck, a pool deck, such as a concrete pavement, driveway or sidewalk.

The apparatus 10 also includes a plurality of elongated, independent, discrete bumper rails, such as the side bumper rails 19 and the end bumper rails 20, each of which has free end portions.

Two of the side rails 19 are laid end-to-end with their ends spaced apart in longitudinal alignment, along the side edge 14 of the mat 11, while the other two side rails 19 are also mounted and spaced apart in end-to-end relationship in longitudinal alignment along the opposite side edge 15 of the mat 11. Each of the end bumper rails 20 is mounted or located along the corresponding end edges 16 and 17 of the mat 11. As disclosed in the drawings, and in order to expose the entire playing surface 12 of the mat 11, each of the bumper rails 19 and 20 are located outside of or outboard of, and along and in contiguous relationship with, their corresponding side edges 14 and 15 and end edges 16 and 17, respectively.

The relative length and width of the mat 11 and the corresponding bumper rails 19 and 20 is such that when the bumper rails 19 and 20 are mounted upon the support surface 18 to encompass the margin of the mat 11, there is a space, or pocket space 21, 22 between corresponding adjacent ends of adjacent bumper rails 19 and 20. Each of the pocket spaces 21 represents a corner pocket space defined between the ends of a pair of a corresponding side rail 19 and an end rail 20 disposed at right angles to each other. The pocket spaces 22 are the middle pocket spaces between a pair of aligned side bumper rails 19, on opposite sides of the mat 11.

In a preferred form of the invention, all of the side bumper rails 19 are of equal length, but less than half the length of the mat 11, so the side rails will position their corresponding pocket spaces 22 at the middle of the playing surface 12, and the combined lengths of the aligned pairs of side rails will be less than the length of the playing mat 11. Each of the end bumper rails 20 is also equal in length to the other end bumper rail 20 but is not quite as long as its corresponding end edge 16 and 17. Thus the end portions of the end bumper rails 20 are spaced from the opposed ends of the side bumper rails 19 to define the corresponding corner pocket spaces 21. The pocket spaces 21 and 22 are each wide enough to permit the free passage of a playing piece therethrough, such as a golf ball, a playing disk, or any other type of movable playing piece, not shown.

The bumper rails 19 and 20 may be made of any desired material, but preferably are heavy enough that they will lie detached and solely supported upon the support surface 18 adjacent the edges of the mat 11 and remain in that position when a playing piece, such as a golf ball, strikes the inner face 23 and 24 of the corresponding bumper rail 19 and 20 during play. Each of the bumper rails 19 and 20 is of such length and weight that each may be lifted and handled by one person for transportation and/or storage and for placing the bumper rails 19 and 20 in an operative position as disclosed in FIG. 1. Preferably, at least the inner surfaces 23 and 24 are slightly elastic or resilient to provide a rebound surface for a playing piece striking that interior surface during play.

Although each bumper rail 19 and 20 is illustrated as having a square cross-section, nevertheless, the cross-sectional shape may vary. Moreover, although the bumper rails 19 and 20 are illustrated as being of solid material, such as wood, or hard rubber, nevertheless, the rails do not have to be of solid material or design.

Each of the side bumper rails 19 and the end bumper rails 20 are also provided with corresponding top surfaces 25 and 26, respectively.

The apparatus 10 further includes a plurality of pocket members 31, 32, 33, 34, 35, and 36, each identified in FIG. 1 by its hole marker pennant 37 displaying the numerals 1–6, respectively. Each of the pocket members 31–36 is preferably substantially identical in construction and includes a semi-flexible wall member 38, preferably of plastic or light metal net material having opposed end portions 39 and 40, a bottom edge 41 and a top edge 42. As best disclosed in the drawings, the end edges 39 and 40 have their lower portions cut back to form lower corner recesses 43 adapted to fit over and receive the opposed end portions of the adjacent side bumper rails 19 and the adjacent side and end bumper rails 19 and 20.

Attached to each of the end portions 39 and 40 of the net or wall member 38 is a vertical connector post 44, the lower end portion of which projects into the recess 43 and is adapted to be received within a socket member or socket hole 45 formed in each end portion of the top surface 25 and 26, respectively, of every bumper rail 19 and 20. Each post 44 may be inserted through the net openings, as shown in the drawings or it may be secured to the net member by fasteners, not shown.

Each of the pennants 37 may be fixed to a pennant post 47 and secured to the wall member 38 by any appropriate fastener 48, or may be inserted through the openings in the mesh of the net wall member 38.

As above described, any of the pocket members 31–36 is readily removable from the apparatus 10 by elevating the connector posts 44 to withdraw them from their corresponding socket holes 45. Thus, each of the pocket members 31–36 is completely separable from the apparatus 10 and may be individually transported or stored in a minimum of space. Moreover, when each of the pocket members 31–36 is properly assembled in the apparatus 10 by inserting the posts 44 into the corresponding socket holes 45, the wall member 38 is disposed entirely outboard of the corresponding bumper rails 19 and 20, with the bottom edge 41 normally resting upon the support surface 18 and with the wall member 38 in a generally arcuate or partially cylindrical form to provide a pocket for completely containing any movable playing piece, such as a golf ball, which enters through the pocket space 21-22 from the playing surface 12.

The playing surface 12 may incorporate different designs or patterns for golf course routes or paths. As illustrated in FIG. 1, the playing surface 12 includes six golf course routes 51–56. Each route 51–56 includes a tee-off or start area adjacent a bumper rail, and preferably adjacent a pocket member 31–36. Moreover, each of the routes 51–56 terminates in a pocket space 21 or 22. For example, route 51, as illustrated in FIG. 1, commences adjacent the front end rail 20 and the pocket member 32, extends diagonally to the opposite side rail 19, then changes direction and crosses the entire width of the playing surface 12 diagonally to one of the opposite side rails 19, where the route 51 again changes course and is directed straight into the upper or rear left corner pocket space 21 corresponding to pocket member 31, which is hole No. 1, as illustrated on the pennant 37.

The other routes 52–56 of different designs terminate in the correspondingly numbered pocket members 32–36, corresponding to holes 2–6, respectively. Thus, route No. 52, starting at the rear end bumper rail 20, terminates in the lower or front right corner pocket or hole no. 2 covered by the transversely spanning pocket member 32. In a similar manner the routes 53, 54, 55, and 56 terminate in corresponding holes 3, 4, 5, and 6 covered by the pocket members 33, 34, 35, and 36, respectively.

In a preferred form of the invention, each of the routes 51–56 may have a color-coded indicator, or may be entirely colored or painted in a color which is different from any other route 51–56. Preferably, each of the netted wall members 38 of the corresponding pocket members 31–36 may also have the same color as their corresponding route 51–56, or each of the pennants 37 may bear the color of its corresponding route 51–56.

Also, if desired, the playing surface 12 may include several simulated hazards, such as the sand traps S and the ponds or water hazards W. Thus, if any player of the game, such as a player using a golf ball and a golf stick or putter attempting to hit the ball to move it along any of the designated routes 51–56, veers from his course and enters or crosses one of the hazards S or W, then a certain number of points may be added to the score, according to the desired rules.

One example of the color coding of the routes 51–56 might be as follows:

| GOLF COURSE ROUTE | COLOR |
|---|---|
| 51 | Red |
| 52 | Brown |
| 53 | White |
| 54 | Gray |
| 55 | Green |
| 56 | Orange |

Figure 4:
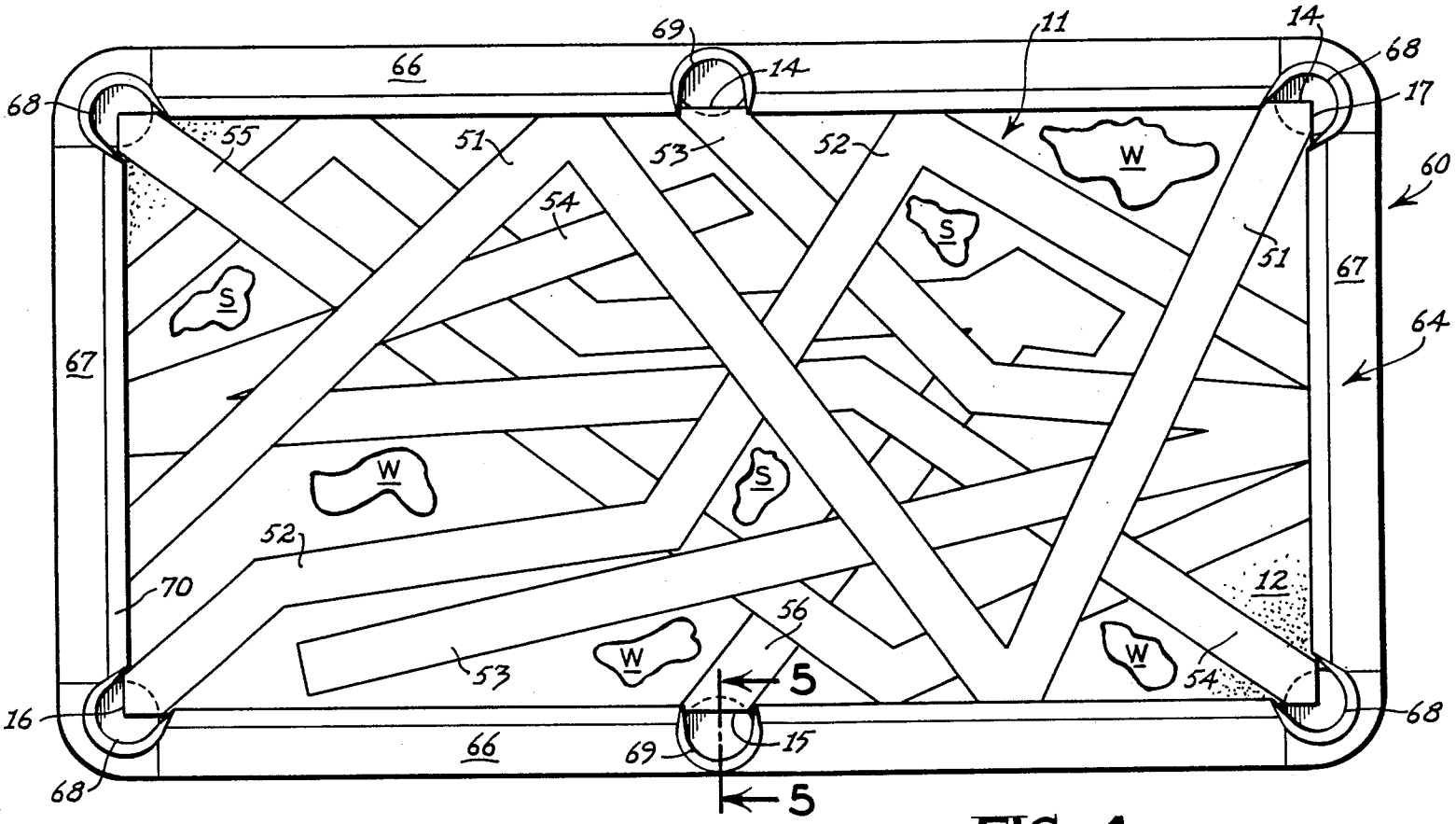
FIG. 4 is a top plan view of a conventional billiards table upon which the playing mat of the game apparatus is supported in operative playing position.
Figure 5:
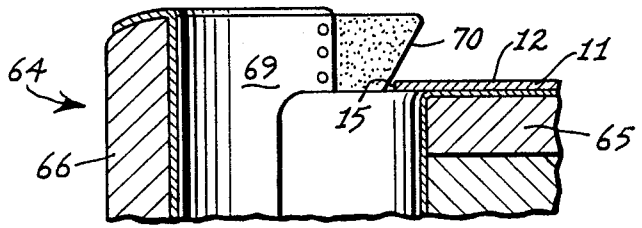
FIG. 5 is an enlarged fragmentary section taken along the line 5—5 of FIG. 4.

In the modified apparatus 60 disclosed in FIGS. 4 and 5, only the mat 11 is laid upon the existing playing or table surface 65 of a conventional pool table 64. The conventional pool table 64, of course, is provided with the continuous side bumper rails 66 and the end bumper rails 67 having the four corner pockets 68 and the two mid-side pockets 69. Each of the routes 51–56 terminate in the same corner pockets 68 and 69 corresponding to the pocket members 31–36 in the apparatus 10.

As illustrated in FIG. 5, a side edge 15 of the mat 11 fits beneath the inclined bumper cushion 70 of the corresponding bumper rails 66 to assist in maintaining the mat 11 in a flat operative position during play. Other edges of the mat 11 also fit beneath the inclined bumper cushions 70 of the corresponding bumper rails 66 and 67.

Otherwise, the apparatus 60 is utilized in the playing of the miniature golf game in the same manner as the apparatus 10, except in the apparatus 60 a conventional billiard ball and billiard cue may be used, while in the apparatus 10, the preferred playing implements are a golf ball and a golf putter. In either apparatus 10 or 60, it will be understood that other types of movable playing pieces may be used, such as a playing disk or puck-type piece. Moreover, other types of sticks or propelling implements may be utilized for moving the playing pieces over the game surface.

It is therefore apparent that an apparatus 10 and 60 has been designed in which the identical flexible mat 11 having the identical playing surface 12 may be utilized in either mode, that is upon a ground surface 18 or upon a conventional pool table 64.

Furthermore, all of the elements of the apparatus, and particularly the apparatus 10, such as the mat 11, the bumper rails 19 and 20, and the plurality of pocket members 31–36 may be quickly assembled and connected together in the manner above described to form the apparatus 10 disclosed in FIG. 1, or they may just as easily be disconnected and removed, stored, or transported in a minimum of space. Furthermore, the same mat 11 may be used by itself for positioning upon an existing pool table 64.

What is claimed is:

1. A miniature golf game apparatus adapted to be played with a movable playing piece and a stick member for propelling the playing piece, in a first mode on a rectangular pool table having marginal bumper rails encompassing a flat table surface and having side and corner pockets, and in a second mode on a flat floor surface, comprising:

(a) a rectangular mat of substantially the same size as the flat table surface of a pool table upon which said mat lies in a flat operative position in a first golf playing mode, (b) said mat having a playing surface, a back surface, and a marginal edge, (c) said mat being made of a flexible material sufficient to permit said mat to be coiled from said operative position into a roll in an inoperative position, (d) a plurality of elongated bumper rails having opposite ends and adapted to extend in spaced end-to-end relationship along said marginal edge to encompass said mat in said flat operative position in a second golf playing mode on a flat floor surface and to define pocket spaces between adjacent ends of said bumper rails, (e) a pocket member for each pocket space comprising a semi-flexible wall member having opposite end portions adapted to span a corresponding pocket space and having a bottom edge portion resting upon said flat floor surface in said second mode, (f) securing means for detachably connecting each end portion of said wall member to an adjacent end portion of a corresponding opposed bumper rail to hold said corresponding pocket member in a closed position spanning said corresponding pocket space to retain a movable playing piece in said pocket space, (g) said playing surface comprising a plurality of golf course routes having a starting end portion and an opposite terminal end portion terminating at a corresponding pocket space when said mat and said bumper rails are in their operative positions in said second mode, and terminating in said pockets in said pool table when said mat is in said operative position upon said table surface in said first mode.

2. The invention according to claim 1 in which said securing means comprises a connector post at each end portion of said wall member, each of said bumper rails having a top surface, and a socket hole extending into the top surface of each of said adjacent ends of said bumper rails, each of said socket holes detachably and cooperatively receiving a corresponding connector post to maintain said corresponding pocket member in said closed position in said second mode.

3. The invention according to claim 2 in which said opposite end portions of each of said wall members comprise lower corner recesses adapted to fit over and receive said adjacent ends of said bumper rails, said connector posts projecting into said corresponding recesses and into said corresponding socket holes in said second mode.

4. The invention according to claim 1 in which said golf course routes and said pocket members are color-coded so that the same color indicia is applied to a golf course route and the pocket member at the pocket space in said second mode or a pocket in said pool table in said first mode in which said golf course route terminates, each golf course route and its corresponding pocket member having different color indicia from any other golf course route and its corresponding pocket member in the second mode or its corresponding pool table pocket in said first mode.

* * * * *